US005357327A

United States Patent [19]

Solano et al.

[11] Patent Number: 5,357,327

[45] Date of Patent: Oct. 18, 1994

[54] SHEET DECURLING SYSTEM INCLUDING CROSS-CURL

[75] Inventors: Suzzette R. Solano, Victor; Christian O. Abreu, Rochester; Patrick T. Ferrari, Walworth; John J. Bigenwald, Penfield; Robert P. Rebres, Honeoye Falls; Theodore J. Kellogg, Rochester; Thomas R. Alexander, Webster, all of N.Y.

[73] Assignee: Xerox Corporation, Stamford, Conn.

[21] Appl. No.: 983,928

[22] Filed: Dec. 1, 1992

Related U.S. Application Data

[63] Continuation-in-part of Ser. No. 864,276, Apr. 6, 1992, abandoned.

[51] Int. Cl.[5] ..... G03G 15/20

[52] U.S. Cl. ..... 355/282; 162/270; 162/271; 355/285; 355/309

[58] Field of Search ..... 355/309, 204, 308, 200, 355/208, 282, 285, 289, 290, 295; 162/270, 271; 271/278, 302, 303, 209, 188

[56] References Cited

U.S. PATENT DOCUMENTS

| | | | |
|---|---|---|---|
| 1,969,073 | 8/1934 | Hamre | 92/70 |
| 3,546,067 | 12/1970 | Heidepriem | 162/271 |
| 3,661,703 | 5/1972 | Shelor | 162/271 |
| 3,865,364 | 2/1975 | Sterner | 271/105 |
| 4,119,309 | 10/1978 | Mayer et al. | 162/271 X |
| 4,326,915 | 4/1982 | Mutschler, Jr. | 162/271 |
| 4,360,356 | 11/1982 | Hall | 162/271 X |
| 4,505,695 | 3/1985 | Billings | 493/459 |
| 4,539,072 | 9/1985 | Frye et al. | 162/197 |
| 4,545,671 | 10/1985 | Anderson | 355/309 |
| 4,561,645 | 12/1985 | Pollich | 271/195 |
| 4,591,259 | 3/1986 | Kuo et al. | 162/271 X |
| 4,627,718 | 12/1986 | Wyer . | |
| 4,652,110 | 3/1987 | Sato et al. | 355/282 X |
| 4,926,358 | 5/1990 | Tani et al. | 364/562 |
| 4,952,281 | 8/1990 | Akira | 162/270 |
| 4,963,943 | 10/1990 | Tamary | 355/290 |
| 4,977,432 | 12/1990 | Coombs et al. | 355/309 |
| 5,017,970 | 5/1991 | Sakata | 355/290 |
| 5,023,038 | 6/1991 | Aslam | 355/290 X |
| 5,038,170 | 8/1991 | Serita | 355/200 |
| 5,066,984 | 11/1991 | Coombs | 355/309 |
| 5,075,734 | 12/1991 | Durland et al. | 355/312 |
| 5,084,731 | 1/1992 | Baruch | 355/208 |
| 5,089,857 | 2/1992 | Xydias | 355/308 X |
| 5,183,454 | 2/1993 | Kurosawa et al. | 162/271 X |
| 5,187,527 | 2/1993 | Forlani et al | 355/282 |

*Primary Examiner*—A. T. Grimley
*Assistant Examiner*—Brasé Sandra L.
*Attorney, Agent, or Firm*—Kenyon & Kenyon

[57] ABSTRACT

A system for decurling a sheet which is being advanced in a predetermined path within a printing machine includes a mechanism for generating a flow of room ambient air. The decurling system further includes a mechanism for directing the flow of room ambient air onto the sheet. Moreover, the decurling system includes a decurler adapted to apply mechanical force to the sheet after the flow of room ambient air has been directed onto the sheet by the directing mechanism. Finally, a mechanism is included for rotating the sheet to advance the sheet to the decurler in a direction substantially perpendicular to the direction of the predetermined path.

20 Claims, 14 Drawing Sheets

SHEET DECURLING SYSTEM INCLUDING CROSS-CURL

This application is a continuation in part of application Ser. No. 864,276 filed on Apr. 6, 1992 now abandoned.

BACKGROUND OF THE INVENTION

This invention relates generally to an apparatus for improving the quality of a sheet, and more particularly concerns a sheet decurling system.

A curl or bend may be created in a sheet as a result of its method of manufacture. In addition, a problem which sometimes occurs in a printing machine such as an electrophotographic printing machine is the development of a curl or bend in the sheet as the sheet passes through the various processing stations of the printing machine.

A curled sheet may be undesirable from a variety of standpoints. For instance, the curled sheet may be difficult to handle as the sheet is processed in a printing machine. Curled sheets may tend to produce jams or misfeeds within the printing machine. Additionally, sheets having a curl or bend therein may be aesthetically undesirable to consumers thereof.

SUMMARY OF THE INVENTION

The present invention provides a system for decurling a sheet which is being advanced in a predetermined path within a printing machine. The decurling system includes a mechanism for generating a flow of room ambient air. The decurling system further includes a mechanism for directing the flow of room ambient air onto the sheet. Moreover, the decurling system includes a decurler adapted to apply mechanical force to the sheet after the flow of room ambient air has been directed onto the sheet by the directing mechanism. A mechanism is also included for rotating the sheet to advance the sheet to the decurler in a direction substantially perpendicular to the direction of the predetermined path. Accordingly the present invention can decurl a sheet in the directions both parallel to and perpendicular to the predetermined path.

Pursuant to another embodiment of the present invention, there is provided a system for decurling a sheet which is being advanced in a predetermined path within a printing machine. The decurling system includes a mechanism for generating and directing a flow of room ambient air onto the sheet. The decurling system further includes a decurler adapted to apply mechanical force to the sheet after the flow of room ambient air has been directed onto the sheet by the generating and directing mechanism.

Other features of the present invention will become apparent as the following description proceeds and upon reference to the drawings.

DETAILED DESCRIPTION

Figure 1:
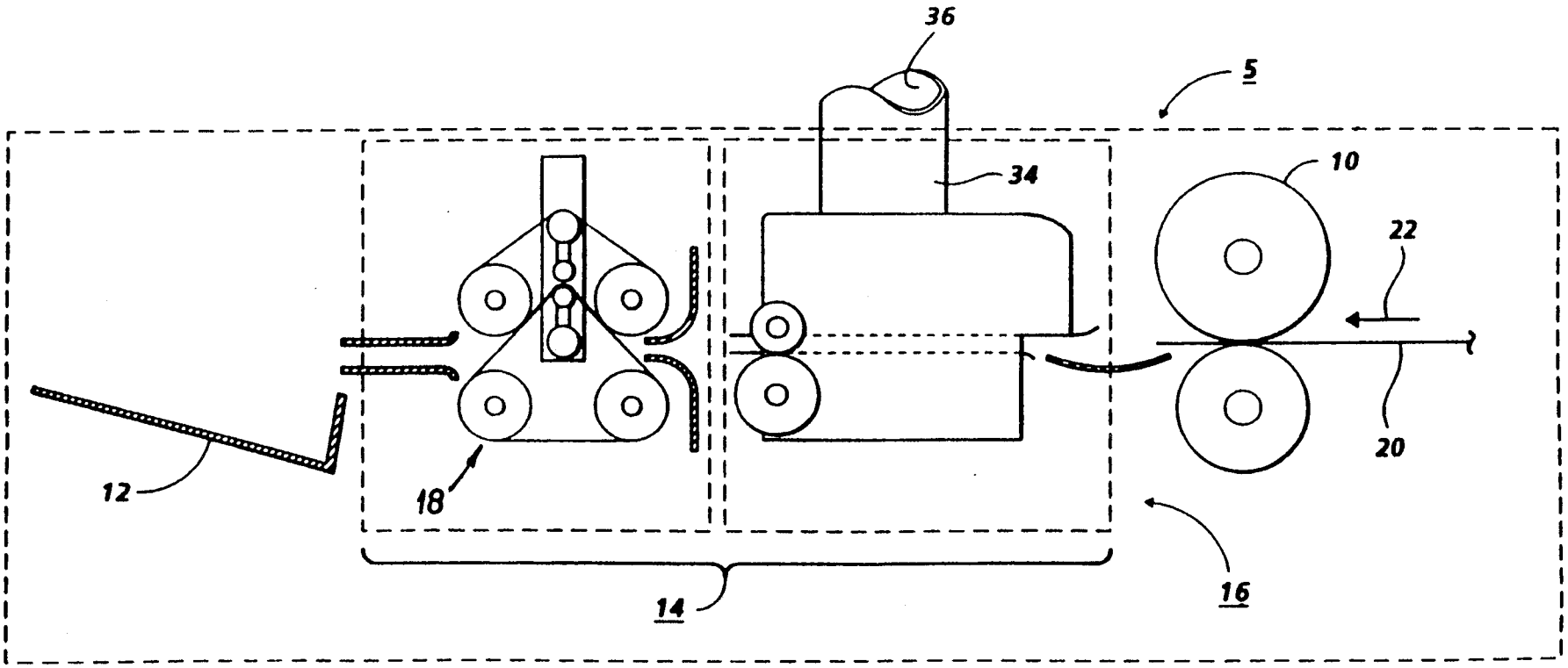
FIG. 1 is a schematic elevational view showing a sheet decurling system of a printing machine incorporating the features of the present invention therein.
Figure 2:
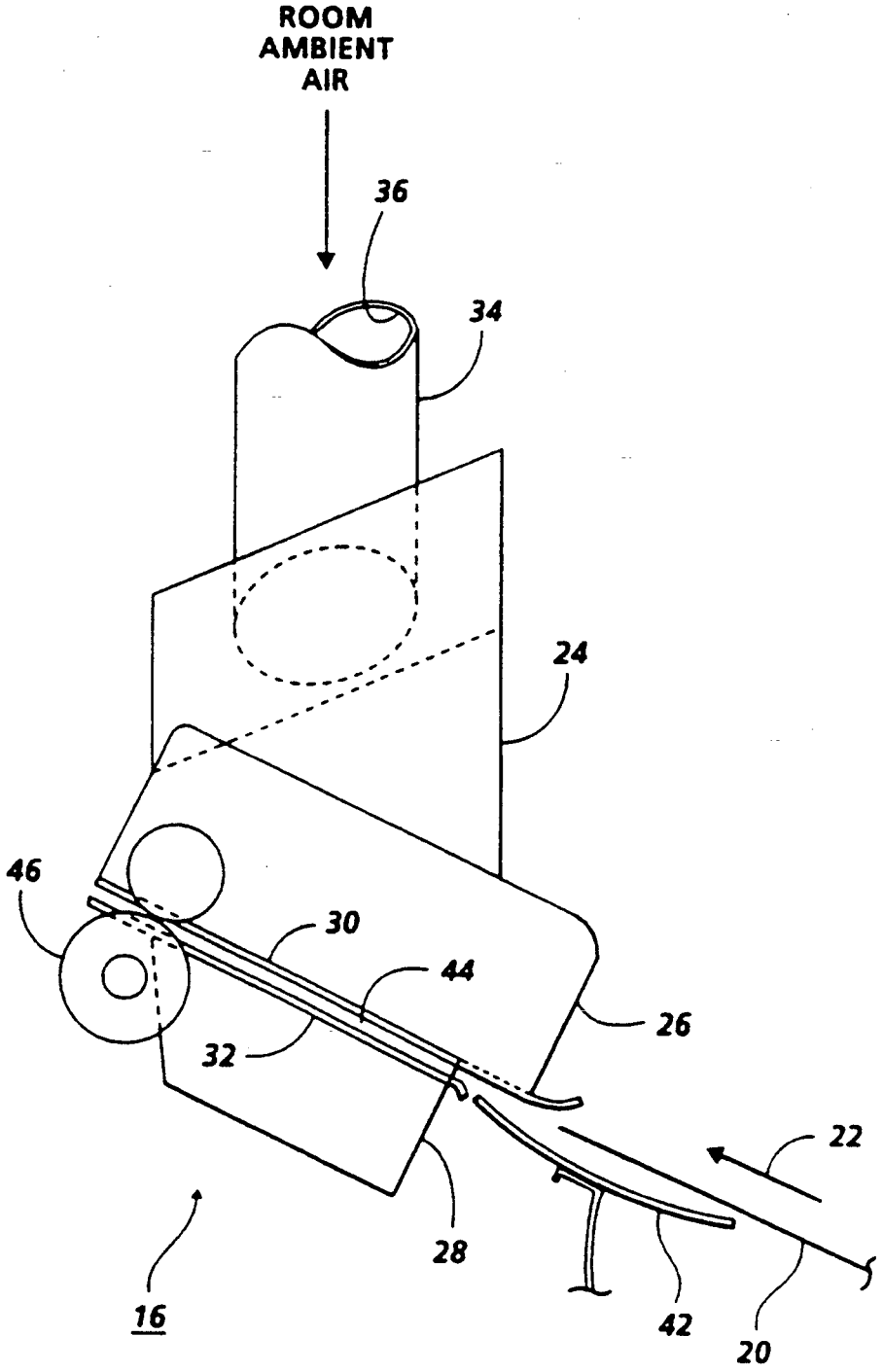
FIG. 2 is a schematic side elevational view showing further details of the equilibrium station used in the sheet decurling system of FIG. 1.
Figure 3:
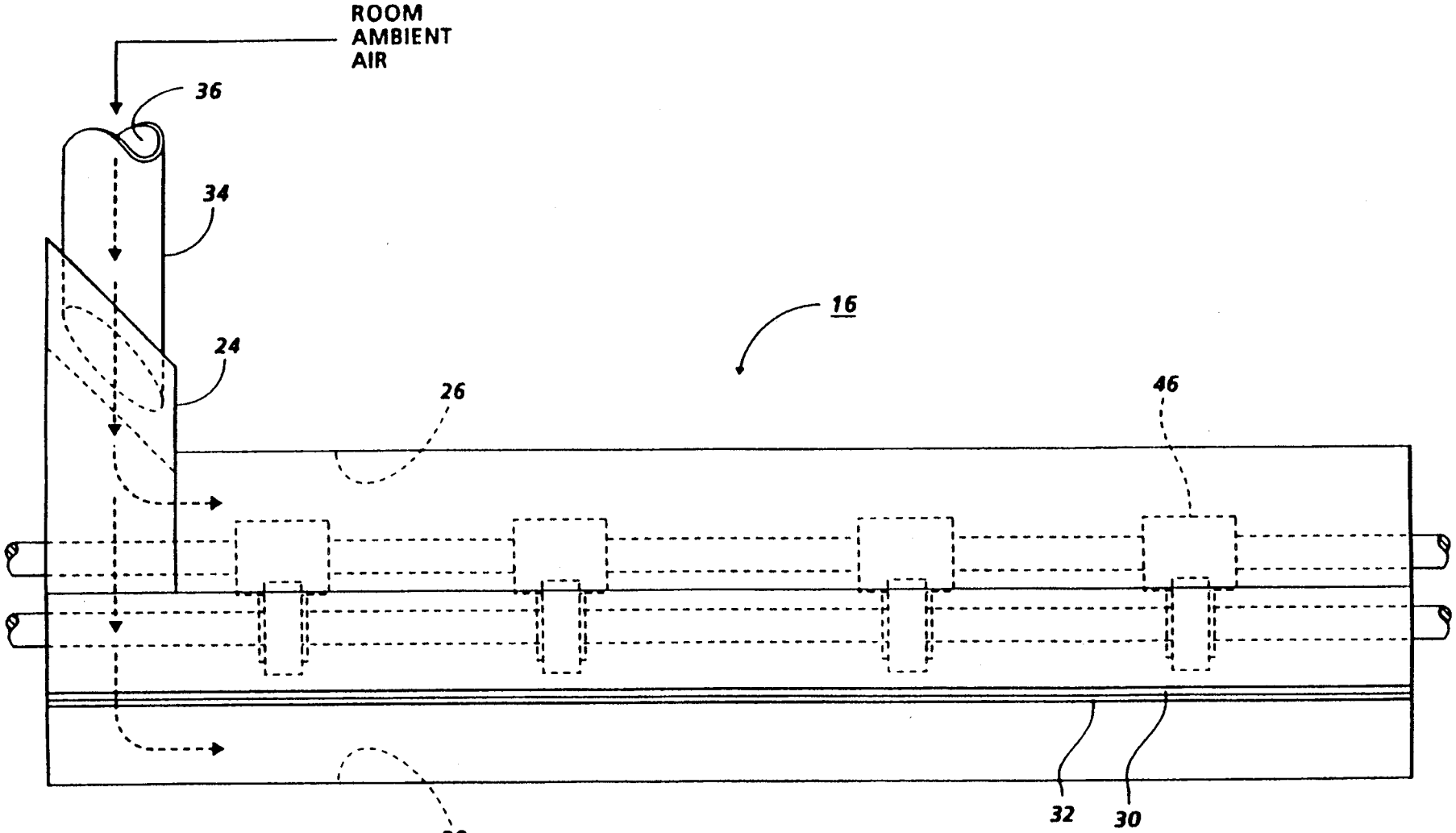
FIG. 3 is a schematic front elevational view of the equilibrium station of FIG. 2.
Figure 4:
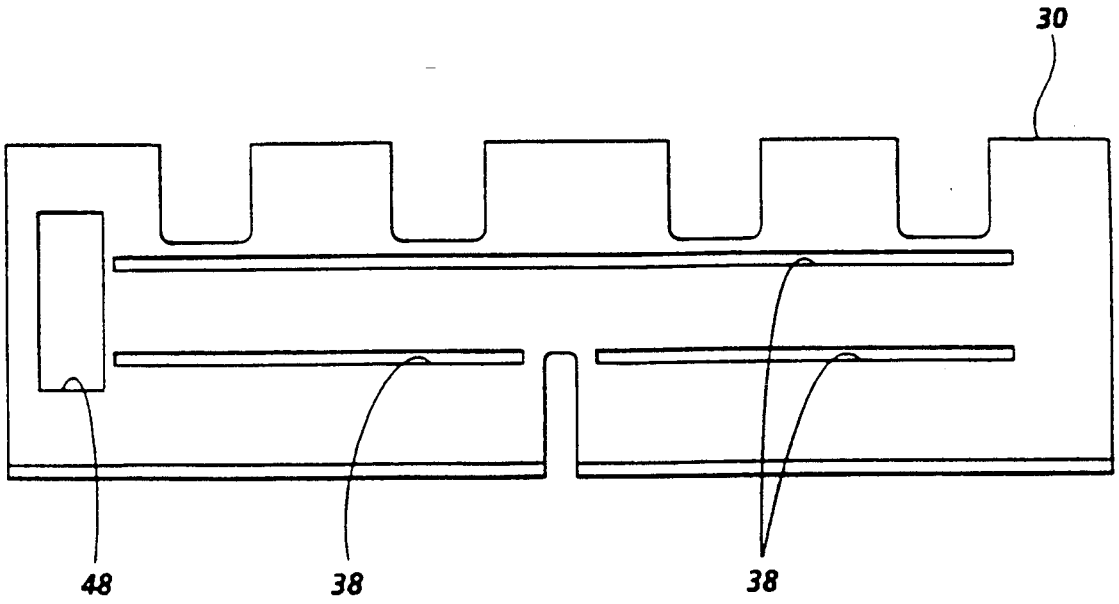
FIG. 4 is a schematic planar view showing the plate of the upper plenum duct of the equilibrium station of FIG. 2.
Figure 5:
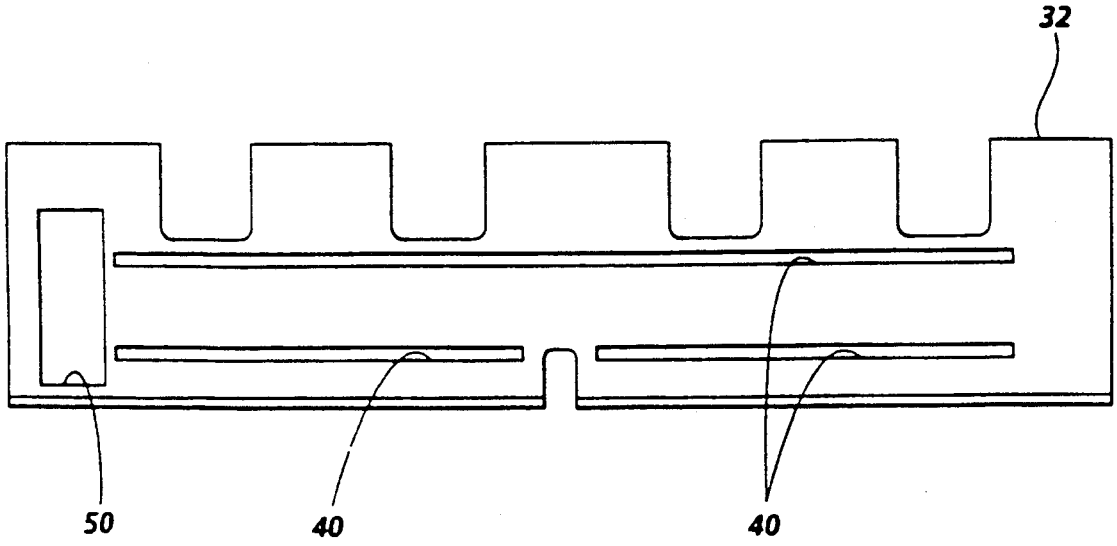
FIG. 5 is a schematic planar view showing the plate of the lower plenum duct of the equilibrium station of FIG. 2.
Figure 6:
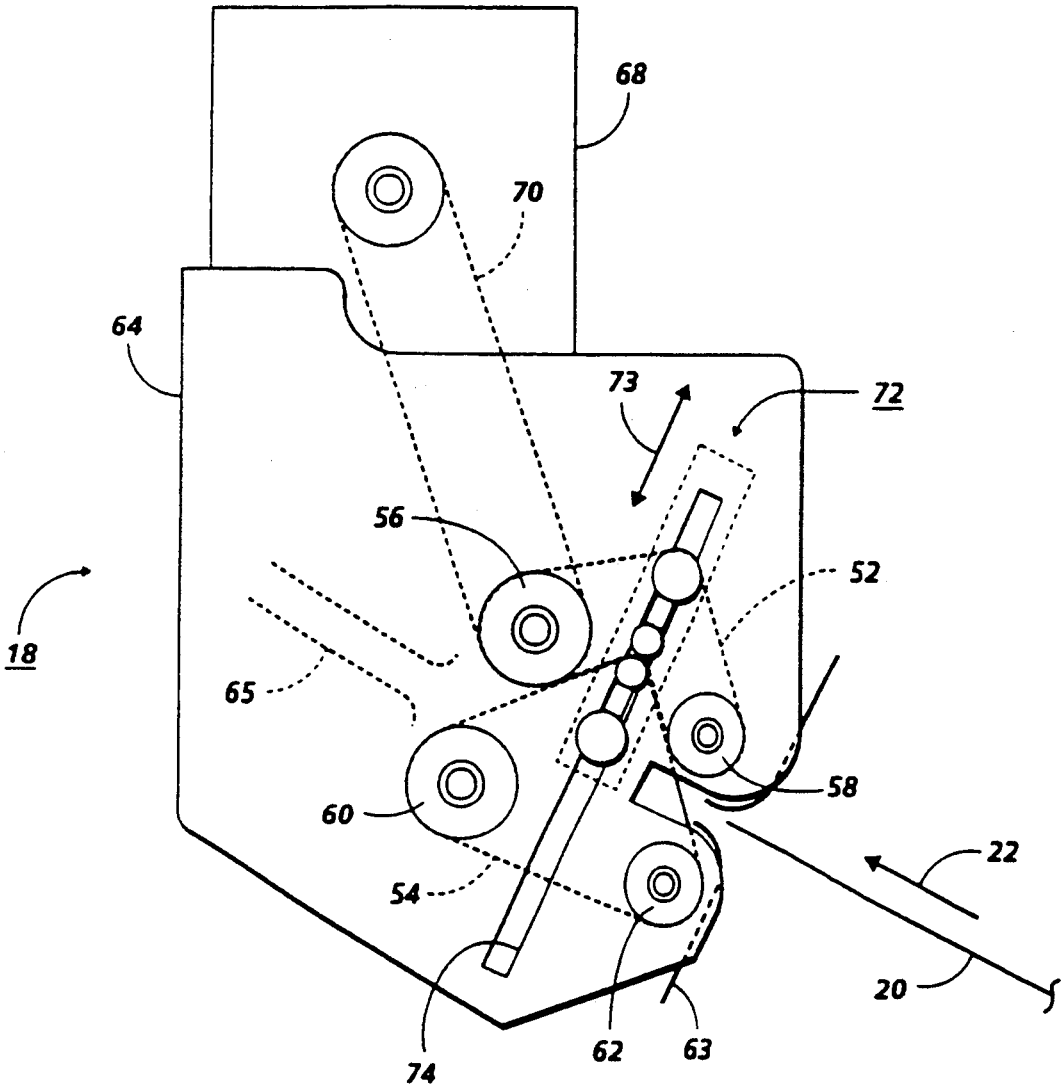
FIG. 6 is a schematic side elevational view showing further details of the belt decurling mechanism used in the sheet decurling system of FIG. 1.
Figure 7:
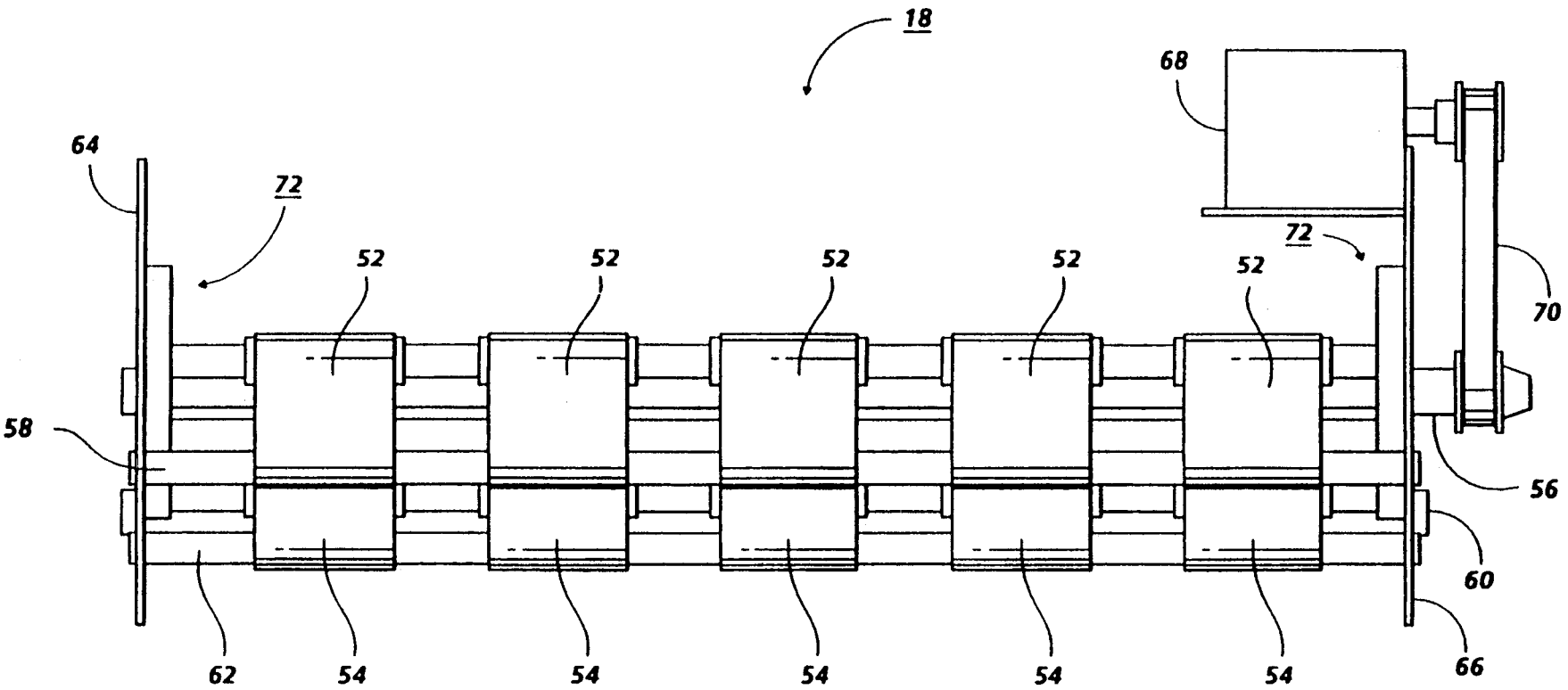
FIG. 7 is a schematic front elevational view of the belt decurling mechanism of FIG. 6 with the inlet baffle removed for clarity of description.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further applications of the principles of the invention as illustrated therein being contemplated as would normally occur to one skilled in the art to which the invention relates.

In FIG. 1 of the drawings, there is shown a printing machine, generally indicated by the reference numeral 5. The printing machine may be an electrophotographic printing machine such as the printing machine described in U.S. Pat. No. 5,075,734 issued to Durland et al., the disclosure of which is hereby incorporated by reference. The printing machine 5 includes a fuser apparatus 10, a catch tray 12 and a sheet decurling system, indicated generally by the reference numeral 14. The sheet decurling system 14 includes an equilibrium station, indicated generally by the reference numeral 16, and a belt decurling mechanism, indicated generally by the reference numeral 18. The decurling system 14 receives a sheet 20, traveling in the direction of arrow 22, from the output of the fuser apparatus 10. The decurling system 14 then physically acts on the sheet to reduce the amount of curl therein and subsequently guides the sheet to the catch tray 12 for subsequent removal therefrom by a machine operator.

The equilibrium station 16 is shown in more detail in FIGS. 2–5. In particular, the equilibrium station 16 includes a fan 34 for producing a current or flow of air. The fan 34 is schematically illustrated by a tube in FIGS. 1–3. The fan 34 has an intake port 36 positioned to receive ambient air directly from a location outside of the printing machine 5 (also see FIGS. 1–3). To achieve the above, the intake port may be positioned adjacent an outer wall of the printing machine 5 or the port may extend beyond an outer wall of the printing machine. Ambient air located outside of the walls of a printing machine has significantly different characteristics, such as temperature and relative humidity levels, in comparison to ambient air located inside of the walls of a printing machine. Ambient air received directly from a location outside of the walls of the printing machine 5 will hereinafter be referred to as "room ambient air" while ambient air received from a location inside of the walls of the printing machine 5 will be hereinafter referred to as "machine ambient air." The equilibrium station 16 further includes a connection duct 24, an upper plenum duct 26 and a lower plenum duct 28. The upper plenum duct 26 includes a plate 30 while the lower plenum duct 28 includes a plate 32. Defined in plate 30 is a number of elongated apertures 38 and an air passageway 48 (see FIG. 4). Similarly, plate 32 has a number of elongated apertures 40 and an air passageway 50 defined therein (see FIG. 5). The upper plenum duct 26 receives a flow of room ambient air via the fan 34 and the connection duct 24. The lower plenum duct 28 receives a flow of room ambient air via the fan 34, the connection duct 24 and passageways 48 and 50. The flow of room ambient air received within upper plenum duct 26 exits through apertures 38 defined in plate 30. Similarly, the flow of room ambient air received within lower plenum duct 28 exits through apertures 40 defined in plate 32. As the sheet 20 is advanced in the direction of arrow 22, the sheet is guided by a guide member 42 into a space 44 defined between plate 30 and plate 32 (see FIG. 2). As the sheet 20 passes through the equilibrium station 16 within the space 44, a flow of room ambient air is directed against both sides of the sheet via the elongated apertures 38 and 40. The equilibrium station 16 further includes a pair of rollers 46 which assists in the advancement of the sheet 20 through the equilibrium station.

The belt decurling mechanism 18 is shown in more detail in FIGS. 6–14. More specifically, the belt decurling mechanism 18 includes a first set of decurler belts 52 and a second set of decurler belts 54. The first set of decurler belts 52 are entrained about a first belt shaft 56 and a second belt shaft 58. The second set of decurler belts 54 are entrained about a third belt shaft 60 and a fourth belt shaft 62. Belt shafts 56, 58, 60 and 62 are each mounted between a pair of side plates 64 and 66. A motor 68 is secured adjacent to the sideplate 66 (see FIG. 7) and mechanically coupled to the first belt shaft 56 by a drive belt 70. In turn, the first belt shaft 56 is mechanically coupled to the third belt shaft 60 by a set of gears (not shown). As the motor 68 rotates the drive belt 70, the first belt shaft 56 and consequently the third belt shaft 60 are caused to rotate. As a result, each of the decurler belts 52 and each of the decurler belts 54 are caused to advance in a recirculating path of movement. The belt decurling mechanism 18 further includes an inlet baffle 63 and an outlet baffle 65.

Figure 8:
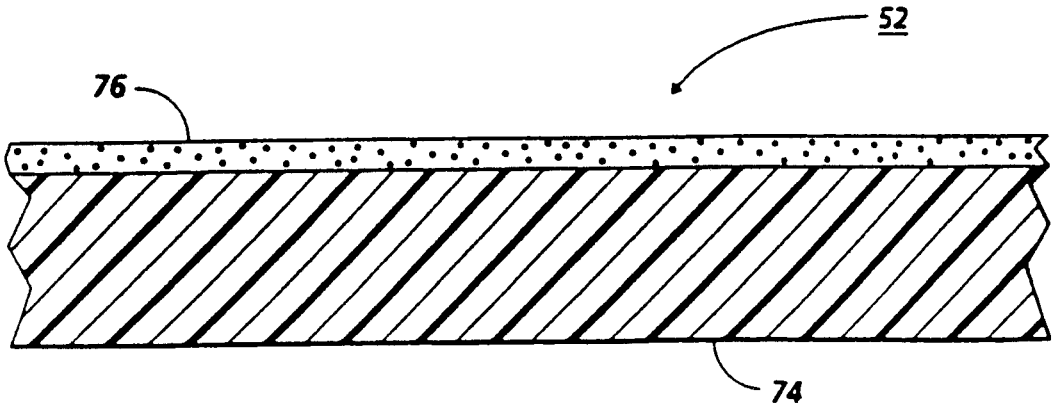
FIG. 8 Is a fragmentary sectional view of one belt of the first set of decurling belts of the belt decurling mechanism of FIG. 6.
Figure 9:
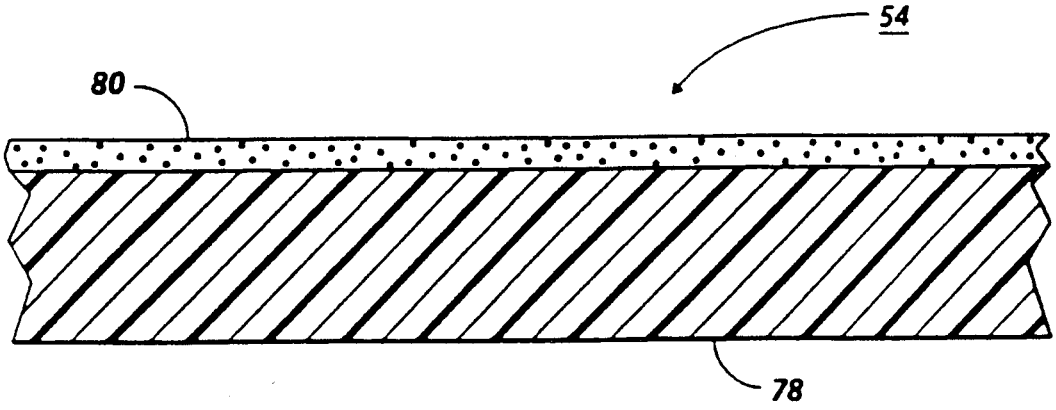
FIG. 9 is a fragmentary sectional view of one belt of the second set of decurling belts of the belt decurling mechanism of FIG. 6.
Figure 10:
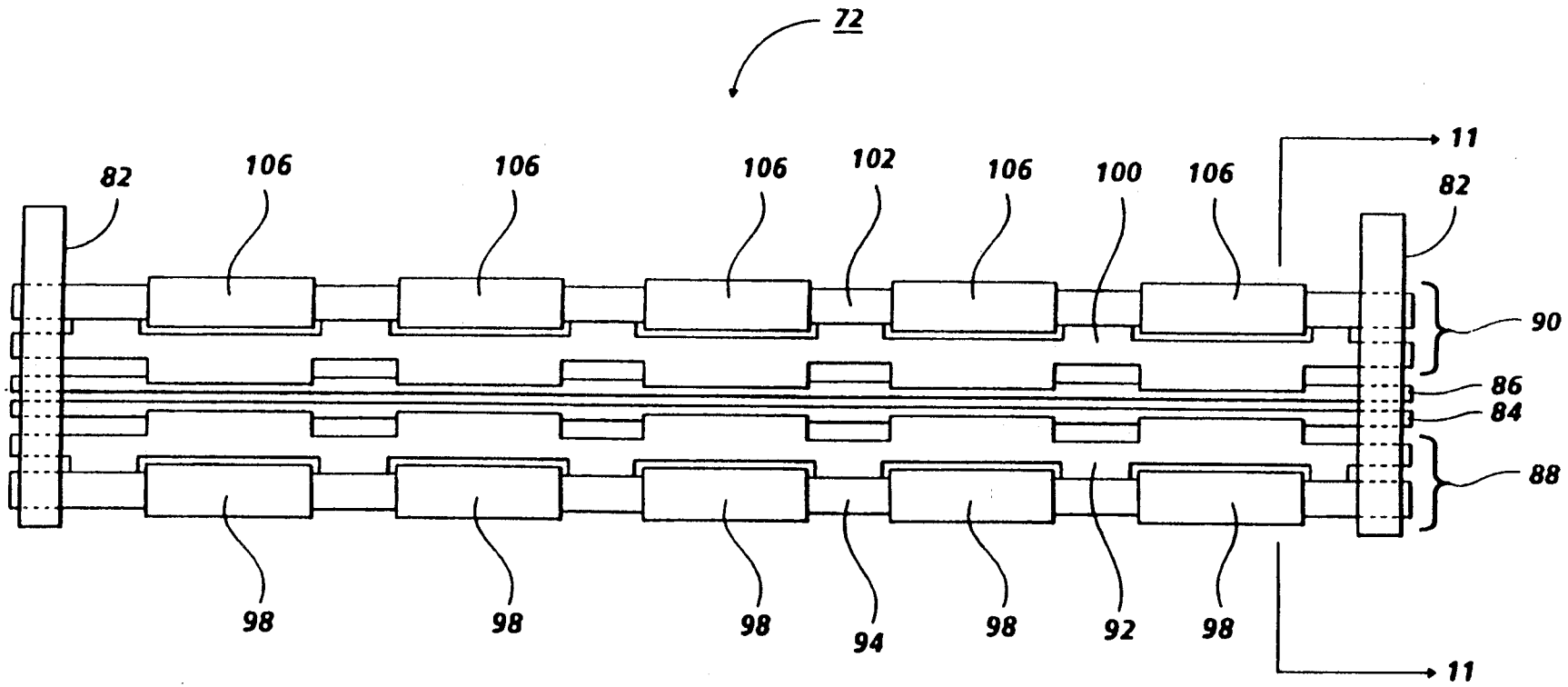
FIG. 10 is a front elevational view of the movable assembly of the belt decurling mechanism of FIG. 6.
Figure 11:
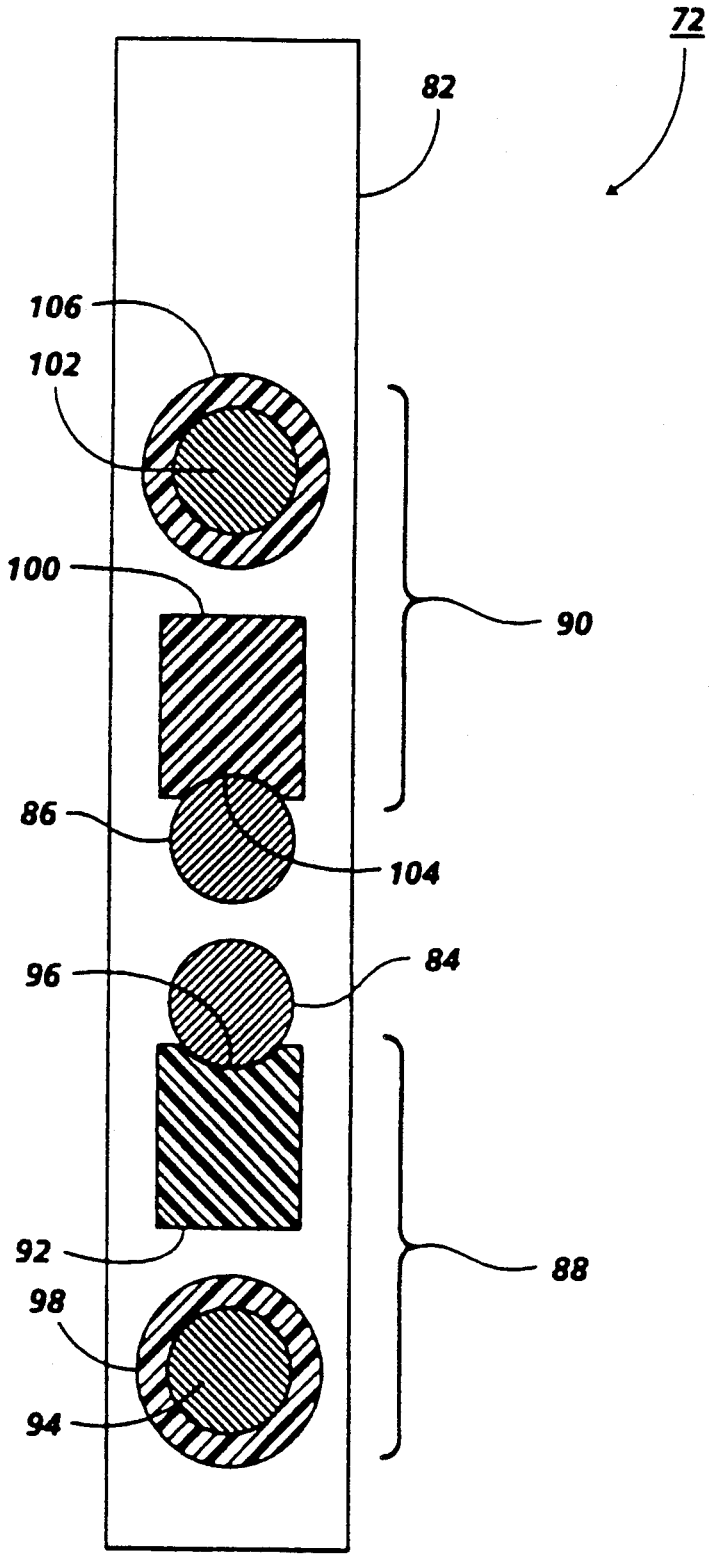
FIG. 11 is a sectional elevational view taken in the direction of arrows 11—11 of FIG. 10 of the movable assembly of FIG. 6.

The decurler belts 52 and 54 are shown in more detail in FIGS. 8 and 9. In particular, the decurler belts 52 are each made from a polyurethane material. As a result, an inner surface portion 74 of each of the decurler belts 52 comprises a polyurethane material. However, molded in an outer surface portion 76 of each of the decurler belts 52 is a dispersion of fine powder material. Preferably, the fine powder material is an ultra high molecular weight polyethylene material. Since the outer surface portion 76 of each of the decurler belts 52 comprises a fine powder material such as an ultra high molecular weight polyethylene material, the frictional resistance between the outer surface portion 76 of each of the decurler belts 52 and the sheet 20 is reduced during advancement of the sheet through the belt decurling mechanism 18. Similarly, the decurler belts 54 are each made from a polyurethane material. As a result, an inner surface portion 78 of each of the decurler belts 54 comprises a polyurethane material. However, molded in an outer surface portion 80 of each of the decurler belts 54 is a dispersion of fine powder material. Preferably, the fine powder material comprises an ultra high molecular weight polyethylene material. Since the outer surface portion 80 of each of the decurler belts 54 comprises a fine powder material such as an ultra high molecular weight polyethylene material, the frictional resistance between the outer surface portion 80 of each of the decurler belts 54 and the sheet 20 is reduced during advancement of the sheet through the belt decurling mechanism 18. During advancement of the sheet through the belt decurling mechanism 18, the sheet is advanced between the outer surface portion 76 of each of the decurler belts 52 and the outer surface portion 80 of each of the decurler belts 54.

The belt decurling mechanism 18 additionally includes a movable assembly, generally indicated by the reference numeral 72. The movable assembly 72 is slidably mounted between sideplates 64 and 66. An elongated slot 74 is defined in sideplate 64 while a similar elongated slot (not shown) is defined in sideplate 66. The movable assembly 72 is selectively positionable at one of a number of positions along the length of the elongated slots as indicated by the two headed arrow 73 in FIG. 6. The printing machine 5 may be equipped with a mechanism (not shown) which allows the machine operator to manually adjust the movable assembly 72 to a desired position or the printing machine may incorporate a mechanism (not shown), including a control system, which automatically adjusts the movable assembly to a desirable position in response to various sensed characteristics of the sheet such as the magnitude of curl in the sheet, the amount of toner on the sheet, and the size and orientation of the sheet. The movable assembly 72 is shown in more detail in FIGS. 10 and 11. The movable assembly includes a pair of end blocks 82. Mounted between the end blocks 82 is a first decurler shaft 84 and a second decurler shaft 86. Also mounted between the end blocks 82 and positioned in contact with the first decurler shaft 84 is a first support assembly 88. A second support assembly 90 is mounted between the end blocks 82 and positioned in contact with the second decurler shaft 86. The first support assembly 88 includes a support beam 92 and a support shaft 94. The support beam 92 is made of an acetal resin material. By way of example, the support beam 92 can be made from DelrinAF, a trademark of E. I. du Pont de Nemours & Co., Inc. of Wilmington, Del. The support beam 92 defines a bearing surface 96 which is positioned to contact the first decurler shaft 84. The first support beam 92 is also positioned to contact the support shaft 94 (see FIG. 10). The first support assembly 88 also includes a number of cylindrical bearings 98, each being positioned around a portion of the support shaft 94 (see FIGS. 7 and 10). The cylindrical bearings 98 are caused to rotate around support shaft 94 when the decurler belts 54 are being advanced and are respectively positioned in contact with the cylindrical bearings 98. The second support assembly 90 includes a support beam 100 and a support shaft 102. The support beam 100 is made of an acetal resin material. By way of example, the support beam 100 can be made from DelrinAF, a trademark of E. I. du Pont de Nemours & Co., Inc. of Wilmington, Del. The support beam 100 defines a bearing surface 104 which is positioned to contact the second decurler shaft 86. The support beam 100 is also positioned to contact the support shaft 102 (see FIG. 10). The second support assembly 90 also includes a number of cylindrical bearings 106, each being positioned around a portion of the support shaft 102 (see FIGS. 7 and 10). The cylindrical bearings 106 are caused to rotate around support shaft 102 when the decurler belts 52 are being advanced and are respectively positioned in contact with the cylindrical bearings 106.

Figure 12:
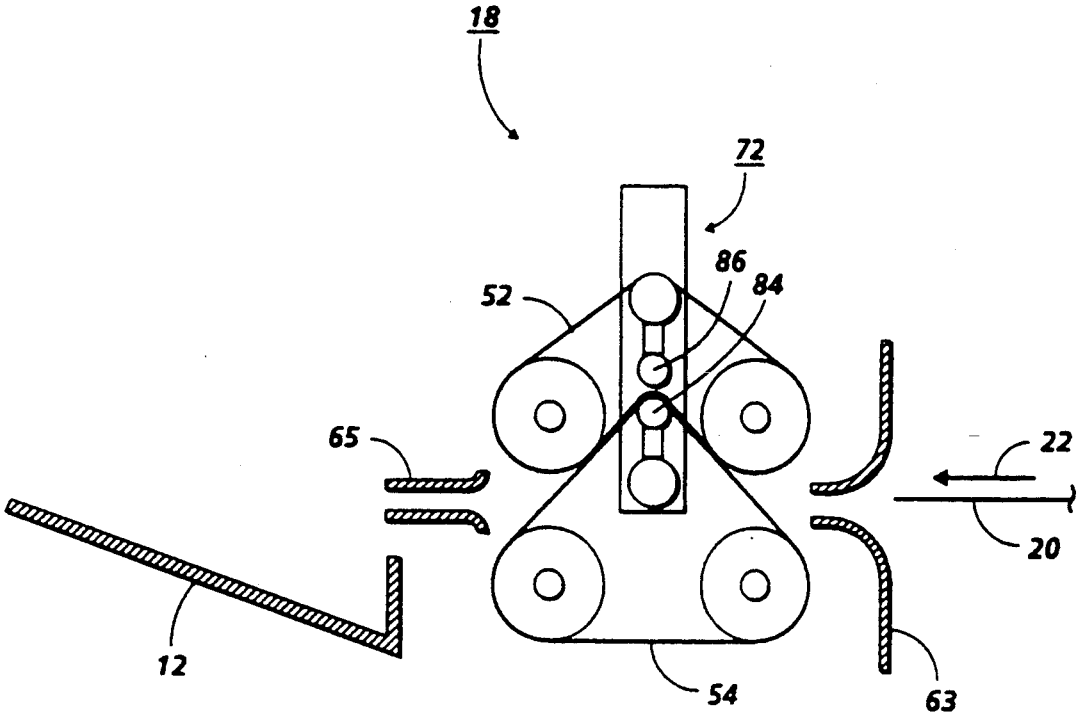
FIG. 12 is a schematic elevational view of a part of the belt decurling mechanism of FIG. 6 showing the movable assembly positioning the first set of decurling belts and the second set of decurling belts to thereby define a path through which the sheet may be advanced.
Figure 13:
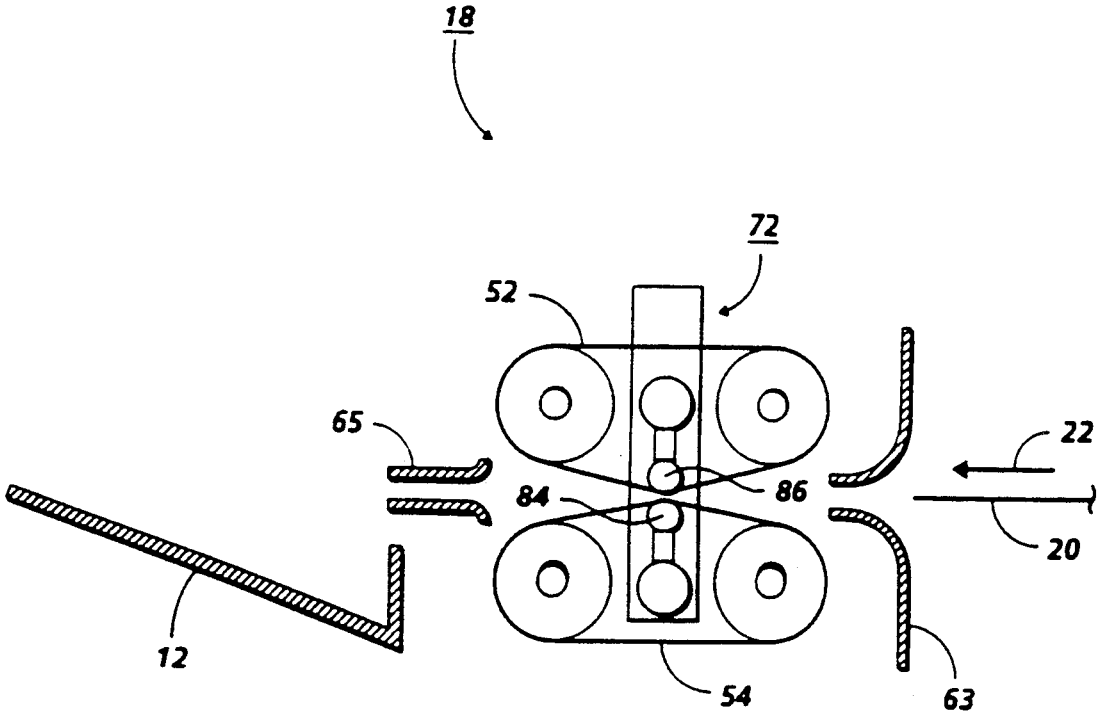
FIG. 13 is a schematic elevational view of a part of the belt decurling mechanism of FIG. 6 showing the movable assembly positioning the first set of decurling belts and the second set of decurling belts to thereby define another path through which the sheet may be advanced.
Figure 14:
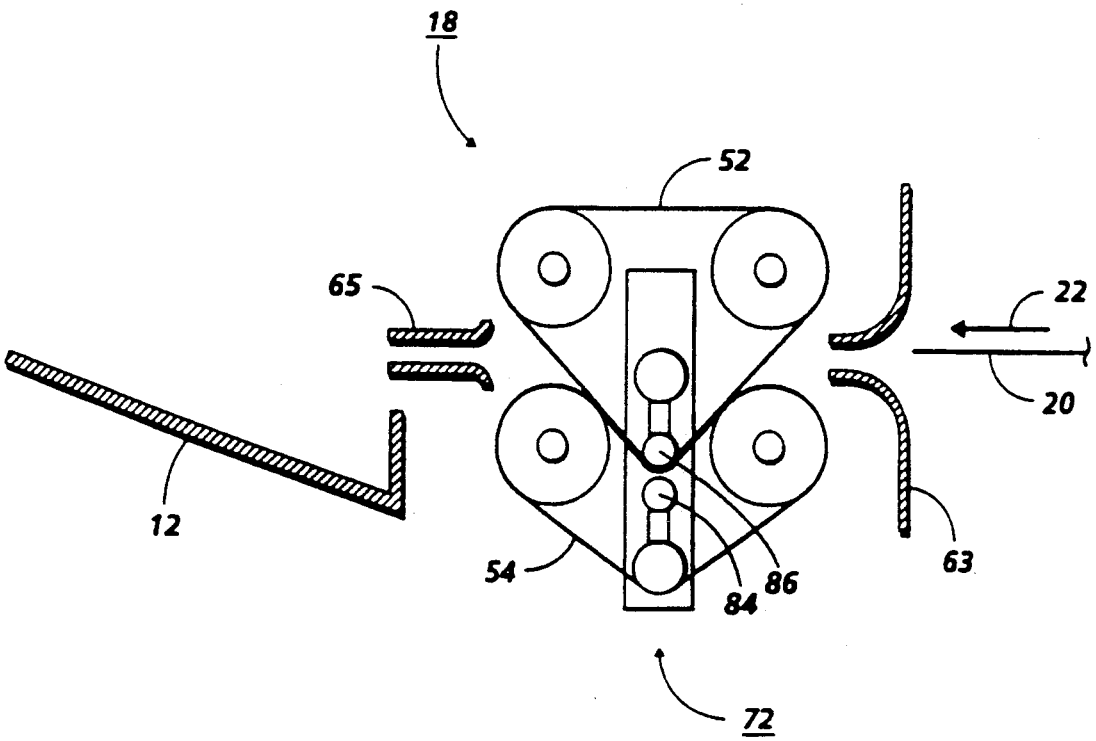
FIG. 14 is a schematic elevational view of a part of the belt decurling mechanism of FIG. 6 showing the movable assembly positioning the first set of decurling belts and the second set of decurling belts to thereby define still another path through which the sheet may be advanced.

An arcuate portion or region of the first decurler shaft 84 is positionable to contact the inner surface portion 78 of each of the decurler belts 54 while an arcuate portion or region of the second decurler shaft 86 is positionable to contact the inner surface portion 74 of each of the decurler belts 52. In operation, the decurler belts 52 and the decurler belts 54 each travel through the space defined between the first decurler shaft 84 and the second decurler shaft 86 (see FIGS. 1, 6 and 10–14). Therefore, as the movable assembly 72 is linearly adjusted to one of a variety of positions, as shown in FIGS. 12–14, the sheet path through the belt decurling mechanism 18 is correspondingly adjusted. As a result, a discrete amount of mechanical force may be applied to the sheet within a range of amounts of mechanical force in either the positive or the negative direction as the sheet is advanced through the nip defined by the area of contact between the outer surface portion 76 of each of the decurler belts 52 and the outer surface portion 80 of each of the of decurler belts 54. When the movable assembly 72 is positioned as shown in FIG. 12, each of the decurler belts 54 are positioned in contact with an arcuate portion of the first decurler shaft 84 while each of the decurler belts 52 are respectively positioned in contact with the decurler belts 54 and are bent around the arcuate portion of the first decurler shaft 84. When the movable assembly 72 is positioned at a neutral decurling position as shown in FIG. 13, the decurler belts 52 are spaced apart from the decurler belts 54. At this neutral decurling position, only a nominal amount of mechanical force is exerted against the sheet by the belt decurling mechanism 18. When the movable assembly 72 is positioned as shown in FIG. 14, each of the decurler belts 52 are positioned in contact with an arcuate portion of the second decurler shaft 86 while each of the decurler belts 54 are respectively positioned in contact with the decurler belts 52 and are bent around the arcuate portion of the second decurler shaft 86.

To aid in the guidance of the sheet through the sheet path of the belt decurling mechanism 18, a strip of flexible material (not shown) may be positioned near the sheet path between each set of neighboring decurler belts 52, and also between each set of neighboring decurler belts 54. Each strip of flexible material would extend from the inlet baffle 63 to the outlet baffle 65 and through the space defined between the first decurler shaft 84 and the second decurler shaft 86.

The sheet decurling system described above reduces curl in the sheet direction (i.e., the direction in which the sheet travels). In certain circumstances it is also desirable to reduce the curl in the sheet which is perpendicular to the sheet direction. The curl in the sheet formed in this perpendicular direction is referred to as cross-curl.

Cross-curl may be imparted to a sheet for a variety of reasons. For example, if the sheet is advanced through the printing machine with its short edge first, cross-curl may occur due to the effects of the toner on the sheet and changes in the moisture content of the sheet. If the sheet is advanced through the printing machine with its long edge first, the effects of the toner may impart a cross-curl to the sheet. Regardless of the source of the cross-curl, it would be advantageous to eliminate or reduce it.

The decurling system 14 may be used to reduce cross-curl as well as curl. To accomplish this task, the sheet is first decurled in the sheet direction as described above. The sheet is then rotated by approximately 90 degrees and advanced through the decurling system 14 a second time to reduce the cross-curl.

Figure 15:
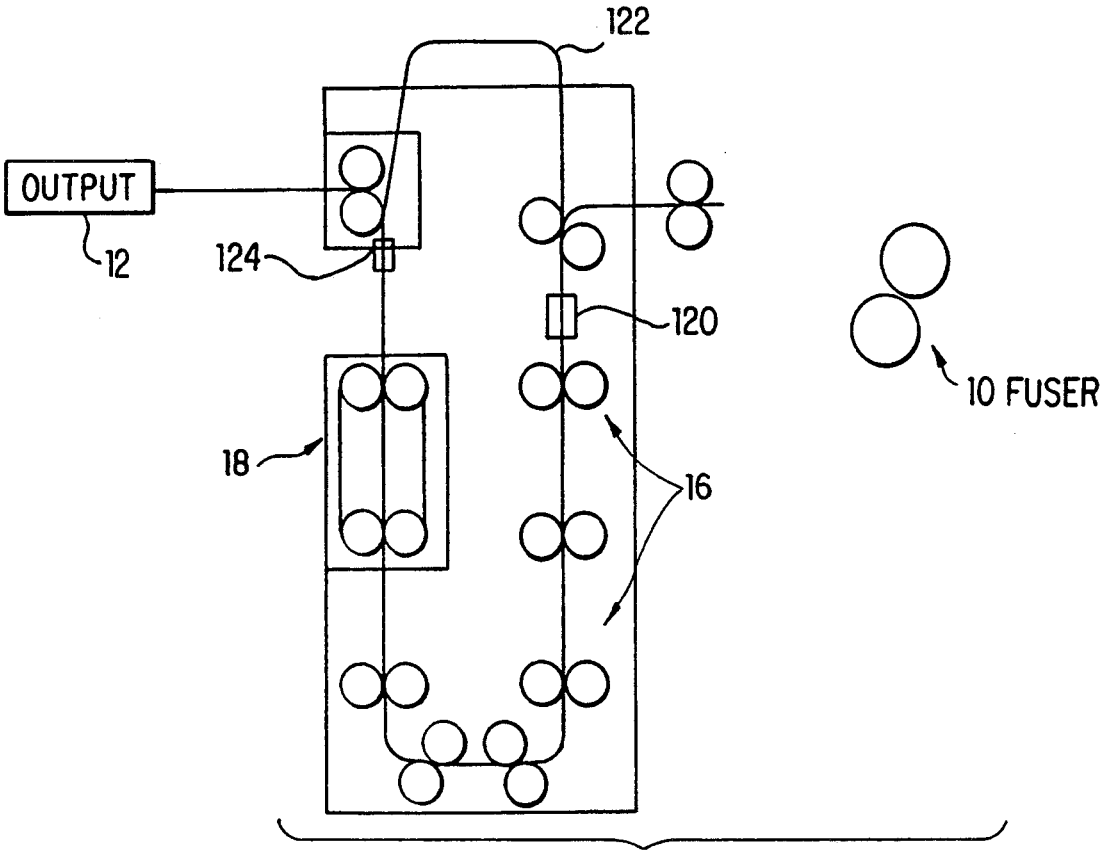
FIG. 15 is a schematic flow diagram of a decurling system for reducing curl and cross-curl.

FIG. 15 shows a schematic flow diagram of a decurling system for reducing curl and cross-curl. Like reference numerals are used in FIGS. 1 and 15 to refer to like components. As seen in FIG. 15, the decurling system 14 includes a sheet rotator 120 disposed near the intake of the decurling system 14 at a position before the equilibrium station 16. A loop transport station 122 is positioned between the output of the belt decurling mechanism 18 and the intake of the decurling system 14. The loop transport station 122 has a gate 124 that directs the sheet either to the catch tray 12 or through the loop transport station 122.

In operation, the sheet is first decurled in the sheet direction as described above. In this first decurling step the sheet advances from the intake of the decurling station 14 through the sheet rotator 120 without undergoing any rotation and through the equilibrium station 16 over a time period that advantageously may be equal to approximately twenty seconds. The sheet next advances through the decurling mechanism 18 to reduce curl in the sheet direction. After traversing the decurling mechanism 18, the gate 124 directs the sheet through the loop transport station 122 which in turn advances the sheet back to the sheet rotator 120. Upon reaching the sheet rotator 120, the sheet undergoes a 90 degree rotation and is advanced through the equilibrium station 16. As a consequence of the rotation, the cross-curl in the sheet is reduced upon traversing the decurling mechanism 18. After exiting the decurling mechanism 18 the sheet is advanced to the catch tray 12 via the gate 124. Alternatively, the gate 124 may direct the sheet through the loop transport station 122 and to the sheet rotator 120 where it is rotated by 90 degrees a second time. As a result of this second rotation, the sheet exits the decurling system 14 in its original orientation, thus facilitating the interfacing of the decurling system 14 with any subsequent output device such as the catch tray 12.

Figure 16:
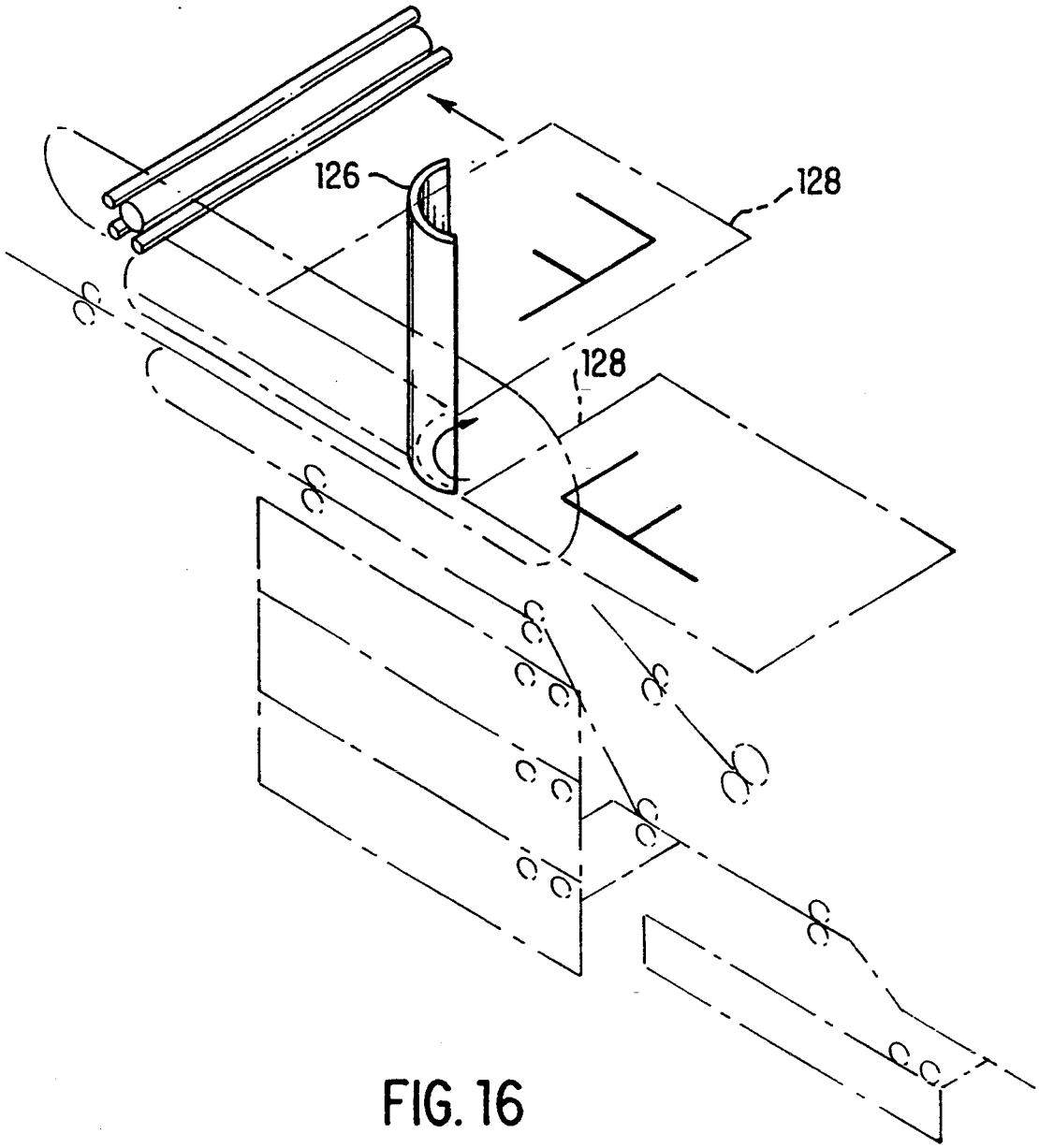
FIG. 16 is a schematic perspective view of a baffle situated along the path of the sheet which serves as a sheet rotator.

The sheet rotator 120 employed by the decurling system 14 may be any type of rotator known in the art, such as, for example, an electronic rotator that rotates the sheet upon detecting its edge. A particularly simple rotator is shown in FIG. 16. As seen in the Figure, a baffle 126 is disposed at an angle of 45 degrees relative to the direction in which the sheet advances. To illustrate the operation of the baffle 126, FIG. 16 shows a sheet advancing toward the baffle 126 with its short end first. The letter "F" is written on the sheet to aid in describing the rotation process which the sheet undergoes. Upon reaching the baffle 126, the top left edge 128 of the sheet is inhibited from further forward motion. Rather, the edge 128 rises upward along the baffle 126 as the sheet advances. Upon reaching a certain height the edge 128 falls backward over the remainder of the sheet so that it subsequently occupies the lower right hand corner position and the sheet is oriented with its long edge first, as shown in FIG. 16.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

We claim the following:

1. A system for decurling a sheet having a length and a width which is being advanced in a predetermined orientation with one of said length or said width oriented parallel to a direction of movement along a predetermined path within a printing machine, comprising:

means for generating a flow of room ambient air;

means for directing the flow of room ambient air onto the sheet;

a decurler adapted to apply mechanical force to the sheet after the flow of room ambient air has been directed onto the sheet by said directing means;

means for rotating the sheet to advance the sheet to the decurler in an orientation with the other of said length or said width oriented parallel to the direction of movement along the predetermined path.

2. The decurling system of claim 1 wherein said rotating means is disposed at a position along the predetermined path before said directing means.

3. The decurling system of claim 2 further comprising means for advancing the sheet from the decurler to the sheet rotator.

4. The decurling system of claim 3 further comprising a gate for selectively advancing the sheet to an output location or the advancing means.

5. The decurling system of claim 1 wherein said rotating means comprises a baffle disposed at a position forty-five degrees from the direction of the predetermined path.

6. The decurling system of claim 1, wherein said generating means comprises a fan having an intake port positioned to receive ambient air directly from a location outside of the printing machine.

7. The decurling system of claim 1, wherein said directing means comprises a duct positioned to receive the flow of room ambient air from said generating means.

8. The decurling system of claim 7, wherein said duct comprises a plate having an aperture defined therein.

9. The decurling system of claim 8, wherein said plate is positioned substantially adjacent the sheet path.

10. The decurling system of claim 9, wherein said directing means directs the flow of room ambient air onto the sheet through the aperture defined in said plate.

11. A system for decurling a sheet having a length and a width which is being advanced in a predetermined orientation with one of said length or said width oriented parallel to a direction of movement along a predetermined path within a printing machine, comprising:

means for generating and directing a flow of room ambient air onto the sheet; and a decurler adapted to apply mechanical force to the sheet after the flow of room ambient air has been directed onto the sheet by said generating and directing means;

means for rotating the sheet to advance the sheet to the decurler in an orientation with the other of said length or said width oriented parallel to the direction of movement along the predetermined path.

12. The decurling system of claim 11 wherein said rotating means is disposed at a position along the predetermined path before said generating and directing means.

13. The decurling system of claim 12 further comprising means for advancing the sheet from the decurler to the sheet rotator.

14. The decurling system of claim 13 further comprising a gate for selectively advancing the sheet to an output location or the generating and advancing means.

15. The decurling system of claim 11 wherein said rotating means comprises a baffle disposed at a position forty-five degrees from the direction of the predetermined path.

16. The decurling system of claim 11, wherein said generating and directing means comprises a fan having an intake port positioned to receive ambient air directly from a location outside of the printing machine.

17. The decurling system of claim 11, wherein said generating and directing means comprises a duct positioned to receive the flow of room ambient air.

18. The decurling system of claim 17, wherein said duct comprises a plate having an aperture therein.

19. The decurling system of claim 18, wherein said plate is positioned substantially adjacent to the sheet path.

20. The decurling system of claim 19, wherein said plate is positioned such that the flow of room ambient air flows through the aperture therein onto the sheet.

* * * * *

UNITED STATES PATENT AND TRADEMARK OFFICE

CERTIFICATE OF CORRECTION

PATENT NO. : 5,357,327

DATED : October 18, 1994

INVENTOR(S) : Solano Resto, et al

It is certified that error appears in the above-indentified patent and that said Letters Patent is hereby corrected as shown below:

On the title page, item [19], should be --Solano Resto, et al --
item [75], "Suzzette R. Solano: should read
-- Suzzette Solano Resto --.

Signed and Sealed this

Twenty-eighth Day of May, 1996

Bruce Lehman

*Attest:*

BRUCE LEHMAN

*Attesting Officer*

*Commissioner of Patents and Trademarks*